United States Patent [19]

Stahlberg

[11] 4,452,023

[45] Jun. 5, 1984

[54] FIXING MEANS

[75] Inventor: Erik Ståhlberg, Espoo, Finland

[73] Assignee: Rakennusruuvi Oy, Helsinki, Finland

[21] Appl. No.: 312,790

[22] Filed: Oct. 19, 1981

[30] Foreign Application Priority Data

Oct. 20, 1980 [FI] Finland ..... 803296

[51] Int. Cl.[3] ..... E04B 1/80; E04B 5/16

[52] U.S. Cl. ..... 52/378; 52/410; 52/506; 52/704; 411/34; 411/531

[58] Field of Search ..... 52/506, 515, 591, 748, 52/410, 592, 408, 409, 411, 412, 590, 589, 309.4, 309.2, 378, 704; 411/34–60, 531

[56] References Cited

U.S. PATENT DOCUMENTS

| | | | |
|---|---|---|---|
| 2,085,215 | 6/1937 | Gonzalez | 52/506 |
| 3,088,361 | 5/1963 | Hallock | 52/363 X |
| 3,236,143 | 2/1966 | Wing | 411/34 |
| 3,257,889 | 6/1966 | Fischer | 411/34 |
| 3,979,866 | 9/1976 | Prescott | 52/573 X |
| 4,309,136 | 1/1982 | Talan | 411/34 |
| 4,380,413 | 4/1983 | Dewey | 411/531 X |

*Primary Examiner*—Alfred C. Perham

[57] ABSTRACT

A fixing means for attachment to a base (1), e.g. to a level concrete roof, of a thermal lagging (3), e.g. a mineral wool mat, said fixing means consisting of a screw (2) or other nail binding to the base and a washer (4) located on top of the lagging, this washer carrying a tubular recess (5) partly penetrating into the lagging (3) and the bottom (6) of which is pierced by the screw and within which the head of the screw (2) resides. To the end of the tubular recess (5) has been connected by stays (7) a plug (8) fitting into a hole drilled in the base (1) and into which the screw (2) can be screwed.

3 Claims, 3 Drawing Figures

Fig.1
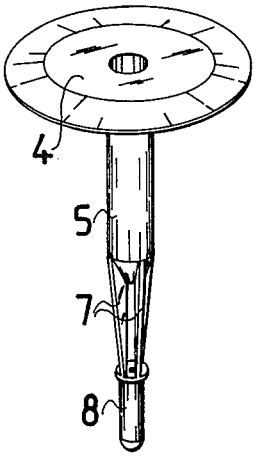
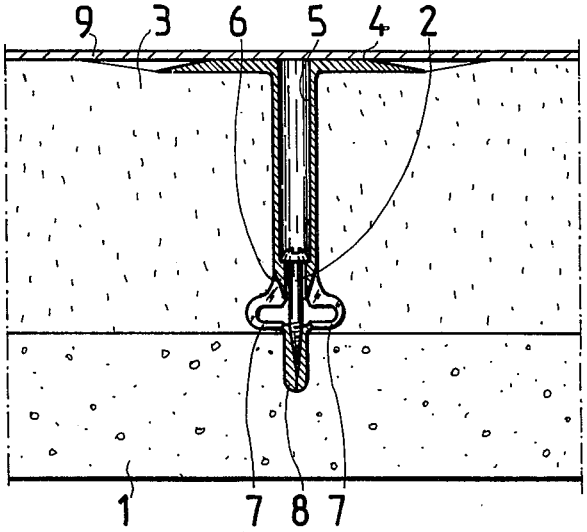
Fig.2
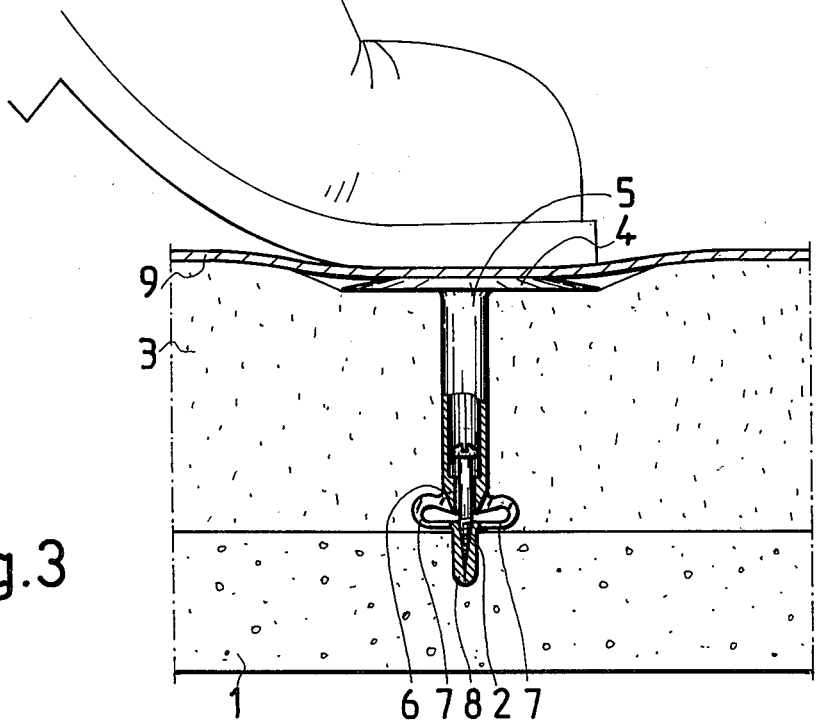
Fig.3

FIXING MEANS

The present invention concerns a fixing means for attachment of a resilient thermal lagging, for instance a mineral wool mat, to a base, for instance a level roof, said fixing means consisting of a screw or other nail entering the base and a washer located upon the lagging and presenting a tubular recess partly penetrating into the lagging, the screw piercing the bottom of this recess and the head of the screw being located in this recess.

The attachment of a lagging to a base of concrete, for instance, has caused various inconveniences because it is difficult to achieve good anchoring of long concrete nails. Therefore, various fixing means with tubular recesses have been developed, but all have the feature in common that they are rigidly affixed to the base. This introduces other drawbacks known in themselves already, namely, that when the lagging is compressed e.g. when a person walks thereon, the fixing means does not contract equivalently and instead projects from the surface of the lagging. When the lagging has been covered with roofing felt or equivalent covering material, the top end of the fixing means will perforate the covering by pushing through.

The object of the present invention is to provide a new type of fixing means. The fixing means of the invention is characterized in that to the end of the tubular recess has by the aid of stays been attached a plug fitting into a hole drilled in the base and into which plug the screw can be screwed. Thanks to the invention, the plug and the screw screwed into the plug are the sole members which will be rigidly connected with base, since the stays bend to the side in connection with fixing. It follows that the rest of the fixing means remains even further on resilient, for instance in the case that it is trod upon.

A favorable embodiment of the invention is characterized in that the stays consist of readily bendable ligaments formed by casting of the same material between the bottom of the recess and the plug. The fixing means made by casting of one material, e.g. of plastic, is easy and favorable to manufacture.

Another embodiment of the invention is characterized in that the plug and stays constitute a substantially downwardly tapering end. When a hard metal drill bit of e.g. 6 mm dia. has been used, through the lagging, to drill a hole in the concrete, a fixing means of this type and the plug on its end will be easily guided to the right spot as it is being installed.

The invention is described in the following with the aid of an example, with reference to the attached drawing, wherein:

FIG. 1 presents a fixing means according to the invention.

FIG. 2 displays the fixing means when mounted, sectioned.

FIG. 3 shows the fixing means of FIG. 2, in another position.

The fixing means consists of a screw 2 binding to the concrete roof 1 and of a washer 4 located upon the lagging 3, this washer carrying a tubular recess 5 penetrating part of the way into the lagging, the bottom 6 of this recess being pierced by the screw 2 and the head of the screw residing therein. To the end 6 of the tubular recess 5 has been connected by stays 7 a plug 8 fitting into the hole drilled in the concrete and into which plug the screw 2 may be screwed. The stays 7 are formed between the bottom 6 of the tubular recess 5 and the plug 8, in the form of ligaments made by casting of the same material, and which are readily flexible.

Upon the poured concrete roof 1 is spread out a mineral wool mat 3, through which is drilled into the concrete for the plug 8 a hole of e.g. 6 mm diameter. The fixing means is pushed with the plug 8 first through the lagging 3 so that the plug enters the hole drilled in the concrete 1. A screw 2 is dropped down into the tubular recess 5, and this screw is used to draw the washer 4 tight against the lagging. The plug 8 is tightly fixed in the concrete, and the stays 7 bend to the side. On top of all, a roofing felt 9 is spread out. When a person walks on the roof and treads upon a fixing means, the fixing means will yield downwardly as shown in FIG. 2 and will not damage the roofing felt.

It is obvious to a person skilled in the art that different embodiments of the invention may vary within the scope of the claims following below. For instance, the stays must not necessarily be as shown in the figure: they may equally consist of a thin-walled tube encircling the screw and which is compressed in accordeon fashion. The stays may also consist of a more rigid material and so that they break off in connection with the mounting.

I claim:

1. A fixing means for attachment of a resilient thermal lagging, such as a mineral wool mat, to a base, such as a level roof of concrete, comprising a washer located on top of the lagging and having a hollow tube extending therefrom and penetrating partly into the lagging, a screw located in the interior of the tube and piercing the bottom of said tube, a plug to be tightly fitted into a drilled hole in the base, into which plug the screw can be screwed, and stays connecting said plug to the bottom of the tube.

2. Fixing means according to claim 1, characterized in that the stays consist of easily bendable ligaments formed by casting between the bottom of the tube and the plug of the same material.

3. Fixing means according to claim 1, characterized in that the plug and the stays constitute a substantially downwardly tapering end.

* * * * *